US008645133B2

(12) United States Patent
Järvinen et al.

(10) Patent No.: US 8,645,133 B2
(45) **Date of Patent: *Feb. 4, 2014**

(54) ADAPTATION OF VOICE ACTIVITY DETECTION PARAMETERS BASED ON ENCODING MODES

(71) Applicant: Core Wireless Licensing S.a.r.l., Luxembourg (LU)

(72) Inventors: Kari Järvinen, Tampere (FI); Pasi Ojala, Kirkkonummi (FI); Ari Lakaniemi, Helsinki (FI)

(73) Assignee: Core Wireless Licensing S.a.r.l., Luxembourg (LU)

( * ) Notice: Subject to any disclaimer, the term of this patent is extended or adjusted under 35 U.S.C. 154(b) by 0 days.

This patent is subject to a terminal disclaimer.

(21) Appl. No.: 13/761,307

(22) Filed: Feb. 7, 2013

(65) Prior Publication Data

US 2013/0151246 A1 Jun. 13, 2013

Related U.S. Application Data

(63) Continuation of application No. 13/248,213, filed on Sep. 29, 2011, now Pat. No. 8,374,860, which is a continuation of application No. 11/431,423, filed on May 9, 2006, now Pat. No. 8,032,370.

(51) Int. Cl.
*G10L 11/02* (2006.01)
*G10L 19/00* (2013.01)

(52) U.S. Cl.
USPC ..... 704/233; 704/227; 704/210; 704/215

(58) Field of Classification Search
None
See application file for complete search history.

(56) References Cited

U.S. PATENT DOCUMENTS

| | | | |
|---|---|---|---|
| 5,337,251 | A | 8/1994 | Pastor |
| 5,839,101 | A | 11/1998 | Vahatalo et al. |
| 6,260,010 | B1 | 7/2001 | Gao et al. |
| 6,480,822 | B2 | 11/2002 | Thyssen |
| 6,493,665 | B1 | 12/2002 | Su et al. |
| 6,507,814 | B1 | 1/2003 | Gao |
| 7,072,832 | B1 | 7/2006 | Su et al. |
| 7,203,638 | B2 | 4/2007 | Jelinek et al. |
| 7,403,892 | B2 | 7/2008 | Sjoberg et al. |
| 2005/0267746 | A1 | 12/2005 | Jelinek et al. |

FOREIGN PATENT DOCUMENTS

| | | |
|---|---|---|
| WO | 0011650 | 3/2000 |
| WO | 0011654 | 3/2000 |

OTHER PUBLICATIONS

"Advances in Source-Controlled Variable Bit Rate Wideband Speech Coding" by Milan Jelinek et al; Special Workshop in Maui (Swim): Lectures by Masters in Speech Processing, Jan. 12, 2004, pp. 1-8, XP-002272510.

3GPP TS 26.094, V6.0.0; 3rd Generation Partnership Project, Technical Specification Group Services and System Aspects; Mandatory speech codec speech processing functions; Adaptive Multi-Rate (AMR) speech codec; Voice Activity Detector (VAD) (Release 6); Dec. 2004, pp. 1-26.

Tdoc S4 (06)0081; Ericsson: "Tuning of AMR Voice Activity Detection," TSG SA4#38 Meeting, Feb. 13-17, 2006, Rennes, France, pp. 1-8.

*Primary Examiner* — Talivaldis Ivars Smits

(57) ABSTRACT

Encoding audio signals with selecting an encoding mode for encoding the signal categorizing the signal into active segments having voice activity and non-active segments having substantially no voice activity by using categorization parameters depending on the selected encoding mode and encoding at least the active segments using the selected encoding mode.

17 Claims, 3 Drawing Sheets

ADAPTATION OF VOICE ACTIVITY DETECTION PARAMETERS BASED ON ENCODING MODES

FIELD OF THE INVENTION

The invention relates to audio encoding using activity detection.

BACKGROUND OF THE INVENTION

It is known to divide audio signals into temporal segments, time slots, frames or the like, and to encode the frames for transmission. The audio frames may be encoded in an encoder at a transmitter site, transmitted via a network, and decoded again in a decoder at a receiver site, for presentation to a user. The audio signals to be transmitted may be comprised of segments, which comprise relevant information and thus should be encoded and transmitted, such as, for example, speech, voice, music, DTMF, or other sounds, as well as of segments, which are considered irrelevant, i.e. background noise, silence, background voices, or other noise, and thus should not be encoded and transmitted. Typically, information tones (such as DTMFs) and music signals are content that should be classified as relevant, active (i.e. to be transmitted). Background noise, on the other hand, is mostly classified as not relevant, non-active, that is not transmitted.

To this end, there are already known methods which try to distinguish segments within the audio signal which are relevant from segments which are considered irrelevant.

One example of such an encoding method is the voice activity detection (VAD) algorithm, which is one of the major components affecting the overall system capacity. The VAD algorithm classifies each input frame either as active voice/speech (to be transmitted) or as non-active voice/speech (not to be transmitted).

During periods when the transmitter has active speech to transmit the VAD algorithm provides information about speech activity and the encoder encodes the corresponding segments with an encoding algorithm in order to reduce transmission bandwidth.

During periods when the transmitter has no active speech to transmit, the normal transmission of speech frames may be switched off. The encoder may generate during these periods instead a set of comfort noise parameters describing the background noise that is present at the transmitter. These comfort noise parameters may be sent to the receiver, usually at a reduced bit-rate and/or at a reduced transmission interval compared to the speech frames. The receiver uses the comfort noise (CN) parameters to synthesize an artificial, noise-like signal having characteristics close to those of the background noise signal present at the transmitter.

This alteration of speech and non-speech periods is called Discontinuous Transmission (DTX).

Current VAD algorithms are considered relatively conservative regarding the voice activity detection. This results in a relatively high voice activity factor (VAF), i.e. the percentage of input segments classified as active speech. The AMR and AMR-WB VAD algorithms provide relatively low VAF values in normal operating conditions. However, reliable detection of speech is a complicated task especially in challenging background noise conditions (e.g. babble noise at low Signal-to-Noise Ratio (SNR) or interfering talker in the background). The known VAD algorithms may lead to relatively high VAF values in such conditions. While this is not a problem for speech quality, it may be a capacity problem in terms of inefficient usage of radio resources.

However, when employing VAD algorithms, which characterize less segments as active segments, i.e. resulting in lower voice activity factor, the amount of clipping may be increased causing very annoying audible effects for the end-user. In case of challenging background noise conditions, the clipping typically occurs in cases where the actual speech signal is almost inaudible due to strong background noise. When the codec then switches to CN, even for a short period, in the middle of an active speech region, it will be easily heard by the end-user as an annoying artifact. Although the CN partly mitigates the switching effect, the change in the signal characteristics when switching from active speech to CN (or vice versa) in noisy conditions is in most cases clearly audible. The reason for this is that CN is only a rough approximation of the real background noise and therefore the difference to the background noise that is present in the frames that are received and decoded as active speech is obvious, especially when the highest coding modes of the AMR encoder are used. The clipping of speech and contrast between the CN and the real background noise can be very annoying to the listener.

SUMMARY OF THE INVENTION

One object of the invention is to provide for encoding of audio signals with good quality at low bitrates providing improved hearing experience. Another object of the invention is to reduce audible clipping of the encoding. Further, the effect of DTX should be reduced according to a further object of the invention.

A method is proposed, which comprises dividing an audio signal temporally into segments, selecting an encoding mode for encoding the segments, categorizing the segments into active segments having voice activity and non-active segments having substantially no voice activity by using categorization parameters depending on the selected encoding mode, and encoding at least the active segments using the selected encoding mode.

The invention proceeds from the consideration that based on the encoding mode, categorization of the segments may be altered. For example, for high quality encoding, it is unfavorable if segments are categorized as non-active in between active segments producing hearable clipping, if the CN signal is generated with the currently required signal length.

In general, embodiments exploit the applied encoding mode of the speech encoder when setting the voice activity parameters, i.e. criteria, thresholds, reference values, used in the VAD algorithm. For example, the lower the quality of the used codec, i.e. one with lower bit-rate, the more aggressive VAD can be employed, i.e. resulting in a lower voice activity factor, without significantly impacting the resulting quality that the user will experience. Embodiments exploit the finding, that higher quality codecs with a high basic quality are more sensitive to quality degradation due to VAD, e.g. due to clipping of speech and due to contrast between the CN and the real background noise, than lower codec modes. It has been found that the lower quality codecs partially mask the negative quality impact from an aggressive VAD. The decrease in VAF is most significant in high background noise conditions in which the known approaches deliver the highest VAF. While the invention leads to decreased VAF at lower encoding rates, the user-experienced quality is not affected.

It is an advantage of the invention that it provides improved spectral efficiency when encoding audio signals without compromising the user-experienced voice quality. The invention provides a decreased VAF at lower quality coding modes compared to higher quality coding modes.

It has to be noted that the selected encoding mode may be checked for each segment (frame), or for a plurality of consecutive segments (frames). It may be possible that the encoding mode is fixed for a period of time, i.e. several segments, or variable in between each two of the segments. The categorization may adapt both to changing encoding modes as well as fixed encoding modes over several segments. The encoding mode may be the selected bitrate for transmission. Then it may be possible to evaluate an average bitrate over several segments, or the current bitrate of a current segment.

Embodiments provide altering the categorization parameters such that for a low quality of the encoding mode a lower number of temporal segments are characterized as active segments than for a high quality of the encoding mode. Thus, when there is provided only low quality encoding, the VAF is decreased, reducing the number of segments, which are considered active. This does, however, not disturb the hearing experience at the receiving end, because CN in low quality coding is less susceptible than in high quality coding.

The categorization parameters may depend, and altered, based on the encoding bitrate of the encoding mode, according to embodiments. Low bitrate encoding may result in low quality encoding, where increased number of CN segments have less impact than in high quality encoding. The bitrate may be understood as an average bitrate over a plurality of segments, or as a current bitrate, which may change for each segment.

Embodiments further comprise obtaining network traffic of a network for which the audio signal is encoded and setting the categorization parameters depending on the obtained network traffic. It has been found that the reduction in VAF may result in decreased bitrate of the output of the encoder. Thus, when high network traffic is encountered, i.e. congestions in the IP network, the average bitrate may be further reduced by increasing the sensibility of the detection of non-active segments.

Embodiments further comprise obtaining background noise estimates within the audio signal and setting the categorization parameters accordingly.

An energy threshold value may be used as categorization parameter according to embodiments. For example, an autocorrelation function of the signal may be used as energy value and compared to the energy threshold. Other energy values are also possible. Categorizing the segments may then comprise comparing energy information of the audio signal to at least the energy threshold value. The energy information may be obtained from the audio signal using known methods, such as calculating the autocorrelation function. It may be possible that a low quality encoding mode may result in a higher energy threshold, and vice versa.

A signal-to-noise threshold value may be used as categorization parameter according to embodiments. In this case categorizing the segments may comprise comparing signal-to-noise information of the audio signal to at least the signal-to-noise threshold value. The signal-to-noise (SNR) threshold may be adaptive to the used encoding method. The SNR of the audio signal, i.e. in each of the segments, or in a sum of all spectral sub-bands of a segment, may be compared with this threshold.

Pitch information may be used as categorization parameter according to embodiments. In this case categorizing the segments may comprise comparing the pitch of the audio signal to at least the pitch threshold information. The pitch information may further affect other threshold values.

Tone information may be used as categorization parameter according to embodiments. Then, categorizing the segments may comprise comparing the tone of the audio signal to at least the tone threshold information. The tone information may further affect other threshold values.

All of the mentioned categorization parameters are adaptive to at least the used encoding mode. Thus, depending on the encoding mode, the parameters may be changed, resulting in different sensitivity of the categorization, yielding different results when categorizing the audio signal, i.e. different VAF.

Embodiments provide creating spectral sub-bands from the audio signal. Each segment of the audio signal may be spectrally divided into sub-bands. The sub-bands may be spectral representations of the segments. In this case, embodiments provide categorizing the segments using selected as well as all sub-bands. It may be possible to adapt categorization depending on the encoding mode for all or selected sub-bands. This may result in tailoring the categorization for different use cases and different encoding modes.

Spectral information may be used as categorization parameter. Categorizing the segments may comprise comparing the spectral components of the audio signal to at least the spectral information, i.e. reference signals or signal slopes.

The invention can be applied to any type of audio codec, in particular, though not exclusively, to any type of speech codec, like the AMR codec or the Adaptive Multi-Rate Wideband (AMR-WB) codec.

Embodiments can be applied to both energy based and spectral analysis based categorization parameters, for example used within VAD algorithms.

The encoder can be realized in hardware and/or in software. The apparatus could be for instance a processor executing a corresponding software program code. Alternatively, the apparatus could be or comprise for instance a chipset with at least one chip, where the encoder is realized by a circuit implemented on this chip.

Moreover, an apparatus is proposed, which comprises a division unit arranged for dividing an audio signal temporally into segments, an adaptive categorization unit arranged for categorizing the segments into active segments having voice activity and non-active segments having substantially no voice activity by using categorization parameters depending on a selected encoding mode, a selection unit arranged for selecting an encoding mode for encoding the segments, and an encoding unit arranged for encoding at least the active segments using the selected encoding mode.

Further, a chipset is provided, comprising a division unit arranged for dividing an audio signal temporally into segments, an adaptive categorization unit arranged for categorizing the segments into active segments having voice activity and non-active segments having substantially no voice activity by using categorization parameters depending on a selected encoding mode, a selection unit arranged for selecting an encoding mode for encoding the segments, and an encoding unit arranged for encoding at least the active segments using the selected encoding mode.

Moreover, an apparatus is proposed, which comprises division means for dividing an audio signal temporally into segments, adaptive categorization means for categorizing the segments into active segments having voice activity and non-active segments having substantially no voice activity by using categorization parameters depending on a selected encoding mode, selection means for selecting an encoding mode for encoding the segments, and encoding means for encoding at least the active segments using the selected encoding mode.

Moreover, an audio system is proposed, which comprises a division unit arranged for dividing an audio signal temporally into segments, an adaptive categorization unit arranged for categorizing the segments into active segments having voice activity and non-active segments having substantially no voice activity by using categorization parameters depending on a selected encoding mode, a selection unit arranged for selecting an encoding mode for encoding the segments, and an encoding unit arranged for encoding at least the active segments using the selected encoding mode.

Moreover, a system is proposed, which comprises a circuit or packet switched transmission network, a transmitter comprising an audio encoder with a division unit arranged for dividing an audio signal temporally into segments, an adaptive categorization unit arranged for categorizing the segments into active segments having voice activity and non-active segments having substantially no voice activity by using categorization parameters depending on a selected encoding mode, a selection unit arranged for selecting an encoding mode for encoding the segments, and an encoding unit arranged for encoding at least the active segments using the selected encoding mode, and a receiver for receiving the encoded audio signal.

A software program product is also proposed, in which a software program code is stored in a computer readable medium. When being executed by a processor, the software program code realizes the proposed method. The software program product can be for example a separate memory device or a memory that is to be implemented in an audio transmitter, etc.

Also, a mobile device comprising the described audio system is provided.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not drawn to scale and that they are merely intended to conceptually illustrate the structures and procedures described herein.

DETAILED DESCRIPTION OF THE INVENTION

Figure 1:
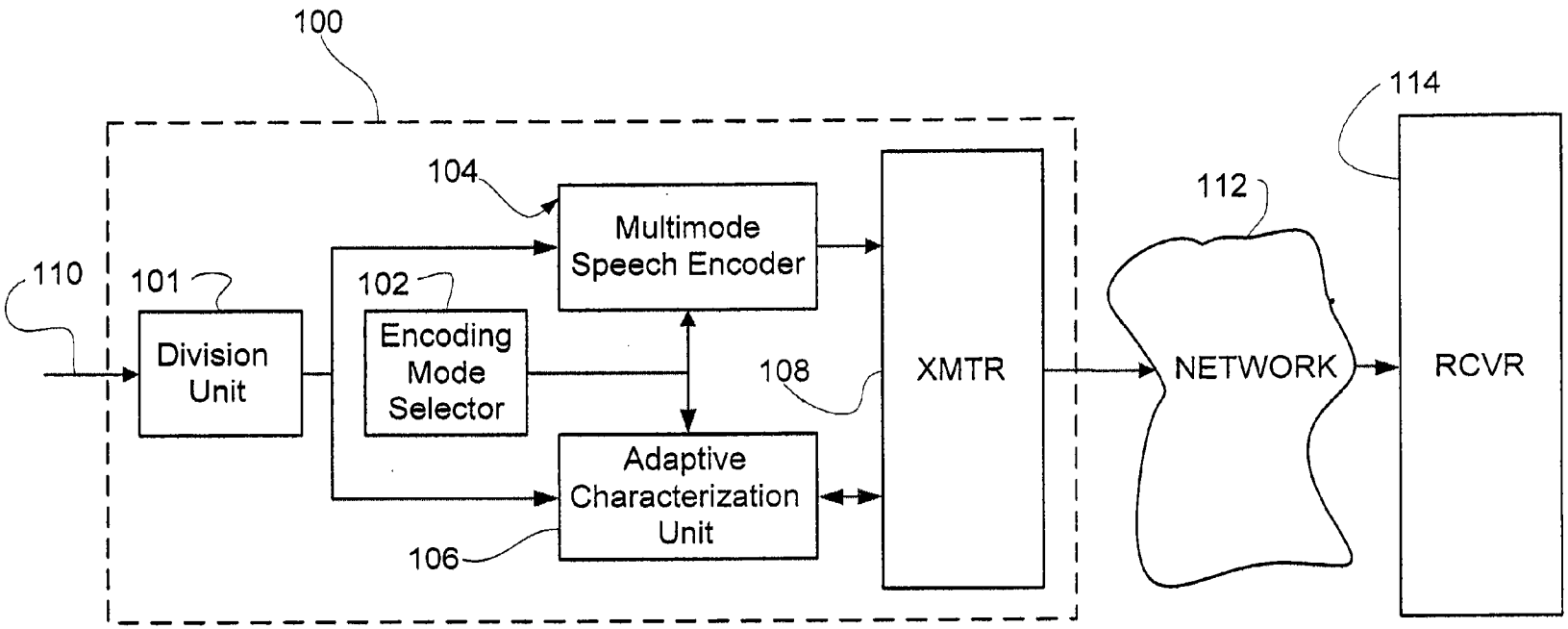
FIG. 1 a system according to embodiments of the invention.

FIG. 1 is a schematic block diagram of an exemplary AMR-based audio signal transmission system comprising a transmitter 100 with a division unit 101, an encoding mode selector 102, a multimode speech encoder 104, an adaptive characterization unit 106 and a radio transmitter 108. Also comprised is a network 112 for transmitting encoded audio signals and a receiver 114 for receiving and decoding the encoded audio signals.

At least the multimode speech encoder 104, and the adaptive characterization unit 106 may be provided within a chip or chipset, i.e. one or more integrated circuits. Further elements of the transmitter 100 may also be assembled on the chipset. The transmitter may be implemented within a mobile device, i.e. a mobile phone or another mobile consumer device for transmitting speech and sound.

The multimode speech encoder 104 is arranged to employ speech codecs such as AMR and AMR-WB to an input audio signal 110.

The division unit 101 temporally divides the input audio signal 110 into temporal segments, i.e. time frames, sections, or the like.

The segments of the input audio signal 110 are fed to the encoder 104 and the adaptive characterization unit 106. Within the characterization unit 106 the audio signal is analyzed and it is determined if segments contain content to be transmitted or not. The information is fed to the encoder 104 or the transmitter 108.

In the encoder 104, the input audio signal 110 is encoded using an encoding mode selected by mode selector 102. Active segments are preferably encoded using the encoding algorithm, and non-active segments are preferably substituted by CN. It may also be possible that the transmitter provides the substitution of the non-active segments by CN, in that case the result of the characterization unit may be fed to the transmitter 108.

The mode selector 102 provides its mode selection result to both the encoder 104 and the characterization unit 106. The characterization unit 106 may adaptively change it operational parameters based on the selected encoding mode or encoding modes over several frames, e.g. average bit rate over certain time period, thus resulting in an adaptive characterization of the input audio signal 110. In addition, the transmitter 108 may provide information about the network traffic to the adaptive characterization unit 106, which allows adapting the characterization of the input audio signal 110 to the network traffic.

Figure 2:
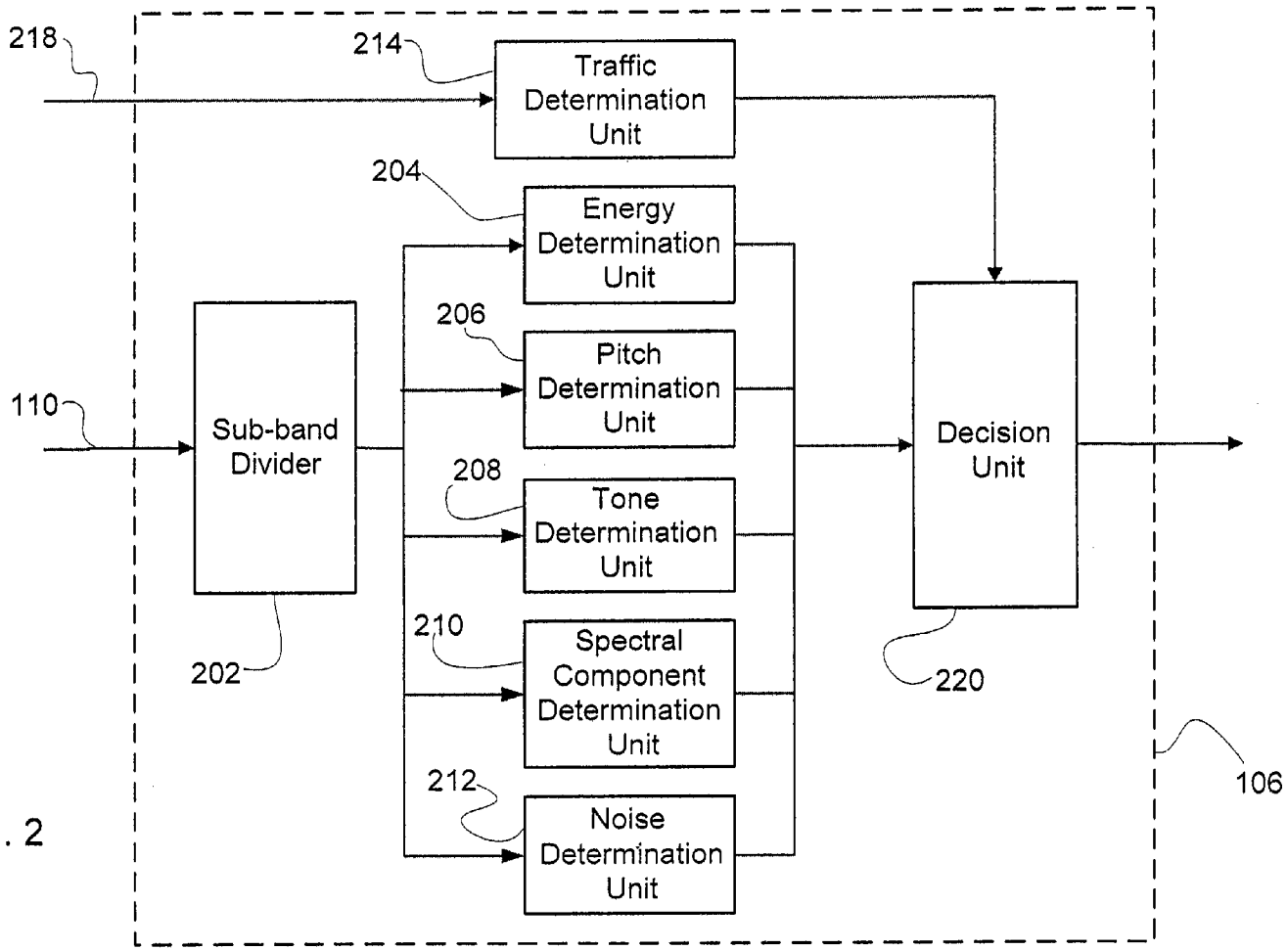
FIG. 2 an adaptive characterization unit according to embodiments of the invention.

FIG. 2 illustrates in more detail the characterization unit 106. The characterization unit 106 comprises a sub-band divider 202, an energy determination unit 204, a pitch determination unit 206, a tone determination unit 208, a spectral component determination unit 210, a noise determination unit 212 and a network traffic determination unit 214. The output of these units is input to decision unit 220. Each of these units perform a function to be described below and as such comprise means for performing that function.

It has to be noted that any combination of the units 204-212 may be used in the characterization unit 106. Input to the characterization unit 106 are the input audio signal 110, information about the selected encoding mode 216 and information about the network traffic 218.

The sub-band divider 202 divides each segment of the input audio signal 110 into spectral sub-band, e.g. in 9 bands between 0 and 4000 Hz (narrowband) or in 12 bands between 0 and 6400 Hz (wideband). The sub-bands of each segment are fed to the units 204-212.

It has to be understood that the sub-band divider 202 is optional. It may be omitted and the input audio signal 110 may then directly be fed to the units 204-212.

The energy determination unit 204 is arranged to compute the energy level of the input audio signal. The energy determination unit 204 may also compute the SNR estimate of the input audio signal 110. A signal representing energy and SNR is output to decision unit 220.

Furthermore, the characterization unit 106 may comprise a pitch determination unit 206. By evaluating the presence of a distinct pitch period that is typical for voiced speech, it may be possible to determine active segments from non-active segments. Vowels and other periodic signals may be characteristic for speech. The pitch detection may operate using open-loop lag count for detecting pitch characteristics. The pitch information is output to decision unit 220.

Within tone determination unit 208, information tones within the input audio signal are detected, since the pitch detection might not always detect these signals. Also, other signals which contain very strong periodic component are detected, because it may sound annoying if these signals are replaced by comfort noise. The tone information is output to decision unit 220.

Within spectral component determination unit 210 correlated signals in the high pass filtered weighted speech domain are detected. Signals, which contain very strong correlation values in the high pass filtered domain are taken care of, because it may sound really annoying if these signals are replaced by comfort noise. The spectral information is output to decision unit 220.

Within noise determination unit 212, noise within the input audio signal 110 is detected. The noise information is output to decision unit 220.

Within network traffic determination unit 214, traffic data 218 from the network 112 is analyzed and traffic information is generated. The traffic information is output to decision unit 220.

The information from units 204-214 are fed to decision unit 220, within which the information is evaluated to characterize the corresponding audio frame as being active or non-active. This characterization is adaptive to the selected encoding mode or encoding modes over several frames, e.g. average bit rate over certain time period, network conditions and noise within the input audio signal. In particular, the lower the quality of the selected encoding mode, the more audio segments may to be qualified as non-active segments, i.e. the decision unit 220 provides more sensitivity to non-active speech, resulting in a lower VAF.

The functions illustrated by the division unit 101 can be viewed as means for dividing, the functions illustrated by the adaptive characterization unit 106 can be viewed as means for categorizing the segments, the functions illustrated by the mode selector 106 can be viewed as means for selecting an encoding mode, the functions illustrated by the encoder 104 can be viewed as means for encoding the input audio signal.

The operation of the decision unit 106 and the transmitter 100 will be described in more detail in FIG. 3.

Figure 3:
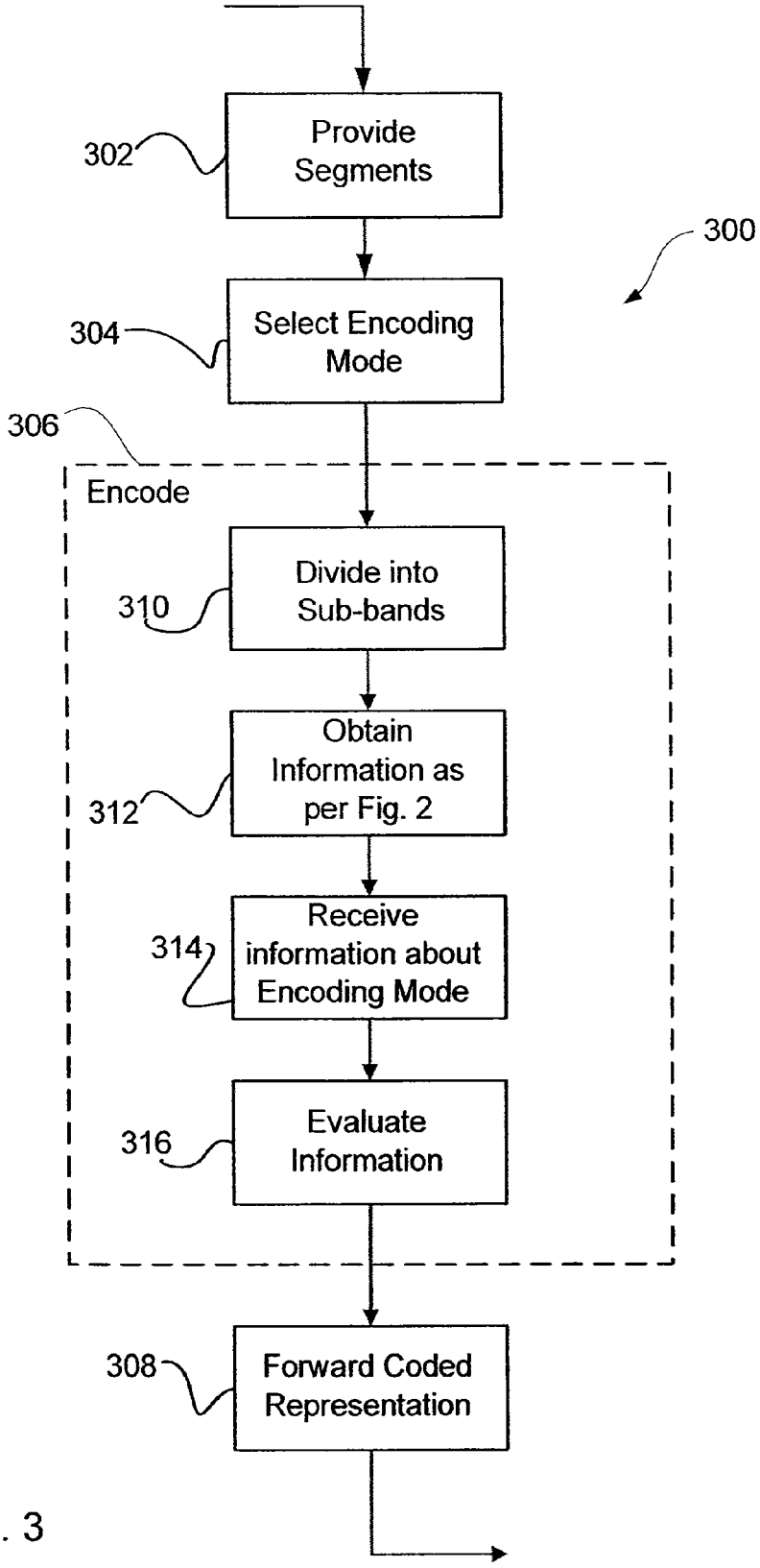
FIG. 3 a flowchart of a method according to embodiments of the invention.

FIG. 3 illustrates a flowchart of a method 300 according to embodiments of the invention.

Segments of the input audio signal 110 are provided (302) to the encoder 104 and the adaptive characterization unit 106 after the input audio signal 101 has been segmented in division unit 101. Within mode selector 102, an encoding mode is selected (304). Using the selected encoding mode, the input audio signal is encoded (306) in the encoder 104. The coded representation of the audio signal 110 is then forwarded (308) to transmitter 108 which sends the signal over the network 112 to the receiver 114.

For encoding (306), the adaptive characterization unit 106 detects speech activity and controls either the transmitter 108 and/or the encoder 104 so that the portions of signal not containing speech are not sent at all, are sent at a lower average bit rate and/or lower transmission frequency, or are replaced by comfort noise.

For characterizing the audio segments as active of non-active, the segments of the input audio signal 110 are divided (310) into sub-bands within sub-band divider 202.

The sub-bands are fed to the units 204-212, where the respective information is obtained (312), as described in FIG. 2. The units 204-212 may operate according to the art, i.e. employing known VAD methods.

In order to adaptively characterize segments of the input audio signal 110 as being active or non-active, the decision unit 220 further receives (314) information about the selected encoding mode, noise information and traffic information.

Then, the decision unit evaluates (316) the information received taking into account the selected encoding mode, noise information and traffic information. For example, the energy information is calculated over the sub-bands of an audio segment. The overall energy information is compared with an energy threshold value, which depends at least on the encoding mode. When the energy is above the energy threshold, it is determined that the segment is active, else the segment is characterized as non-active. In order to account for quality of the encoding mode, it may be possible to increase the threshold value with decreasing encoding quality, such that for lower encoding quality, more segments are qualified as non-active. The threshold may further depend on the traffic information and the noise information. Further, the threshold may depend on pitch and/or tone information.

It may also be possible to use SNR information and SNR thresholds, which may depend at least on the encoding mode. In that case, it may be possible to determine a lower and an upper threshold. The lower and the upper thresholds may depend at least on the selected encoding mode.

Then, each sub-band the corresponding SNR is compared to the thresholds. Only if the SNR is within the thresholds, the SNR of the corresponding sub-band contributes to the overall SNR of the segment. Else, if the sub-band SNR is not within the threshold values, a generic SNR, which may be equal to the lower threshold, is assumed for calculating the overall SNR of the segment. The overall computed SNR of a segment is then compared to the adaptive energy threshold, as described above.

In addition, the spectral information may be utilized and compared with spectral references depending on the selected encoding mode to determine active and non-active segments.

Depending on the evaluation (316), the segments are encoded or replaced by CN or not sent at all, or sent at a very low bitrate and lower transmission frequency. Thus, the selected encoding mode is used not only to select the optimum codec mode for the multimode encoder but also to select the optimal VAF for each codec mode to maximize spectrum efficiency in the overall system.

The advantage of the invention is decreased VAF at lower coding modes of the AMR speech codec, leading to improved spectral efficiency without compromising the user-experienced voice quality.

While there have been shown and described and pointed out fundamental novel features of the invention as applied to a preferred embodiment thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto. Furthermore, in the claims means-plus-function clauses are intended to cover the structures described herein as performing the recited function and not only structural equivalents, but also equivalent structures. Thus although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. A method comprising:

dividing an audio signal into a plurality of segments;

categorizing each of the plurality of segments as an active segment or a non-active segment based at least in part on one or more categorization parameters, at least one of the one or more categorization parameters being dependent upon a selected encoding mode for encoding the segments;

encoding at least those segments of the plurality of segments categorized as active segments using the selected mode for encoding.

2. The method of claim 1, wherein the at least one of the one or more categorization parameters is such that for a low quality of the selected encoding mode a lower number of temporal sections are detected as active sections than for a high quality of the selected encoding mode.

3. The method of claim 1, wherein:

the one or more categorization parameters include at least one parameter that comprises an energy threshold value; and categorizing each of the plurality of segments comprises comparing energy information of the audio signal to at least the energy threshold value.

4. The method of claim 1, wherein:

the one or more categorization parameters include at least one parameter that comprises a signal-to-noise threshold value; and categorizing each of the plurality of segments comprises comparing signal-to-noise information of the audio signal to at least the signal-to-noise threshold value.

5. The method of claim 1, wherein:

the one or more categorization parameters include at least one parameter that comprises pitch information; and categorizing each of the plurality of segments comprises comparing the pitch of the audio signal to at least the pitch information.

6. The method of claim 1, wherein:

the one or more categorization parameters include at least one parameter that comprises tone information; and categorizing each of the plurality of segments comprises comparing the tone of the audio signal to at least the tone information.

7. The method of claim 1, further comprising creating spectral sub-bands from the audio signal.

8. The method of claim 7, wherein categorizing each of the plurality of segments comprises categorizing selected sub-bands.

9. The method of claim 1, wherein the one or more categorization parameters include at least one parameter that is dependent upon noise information.

10. The method of claim 1, wherein the one or more categorization parameters include at least one parameter that is dependent upon traffic information.

11. An apparatus comprising:

a division unit arranged for dividing an audio signal into a plurality of segments;

an adaptive categorization unit arranged for categorizing each of the plurality of segments as an active segment or a non-active based at least in part on one or more categorization parameters, at least one of the one or more categorization parameters being dependent upon a selected encoding mode for encoding the segments; and an encoding unit arranged for encoding at least those segments of the plurality of segments categorized as active segments using the selected mode for encoding.

12. The apparatus of claim 11, wherein the at least one of the one or more categorization parameters depends on an encoding bitrate of the encoding mode.

13. The apparatus of claim 11, wherein the one or more categorization parameters include one or more of:

at least one parameter that comprises an energy threshold value;

at least one parameter that comprises a signal-to-noise threshold value;

at least one parameter that comprises pitch information; and at least one parameter that comprises tone information.

14. The apparatus of claim 11, wherein the one or more categorization parameters include at least one parameter that is dependent upon noise information.

15. The apparatus of claim 11, wherein the one or more categorization parameters include at least one parameter that is dependent upon traffic information.

16. A system comprising:

a transmission network;

a transmitter comprising an audio encoder with a division unit arranged for dividing an audio signal into a plurality of segments;

an adaptive categorization unit arranged for categorizing the plurality of segments into active segments and non-active segments based at least in part on one or more categorization parameters, at least one of the one or more categorization parameters being dependent upon a selected encoding mode for encoding the segments; and an encoding unit arranged for encoding at least those segments of the plurality of segments categorized as active segments using the selected mode for encoding; and a receiver for receiving the encoded audio signal.

17. A chipset comprising:

a division unit arranged for dividing an audio signal into a plurality of segments;

an adaptive categorization unit arranged for categorizing each of the plurality of segments as an active segment or a non-active segment based at least in part on one or more categorization parameters, at least one of the one or more categorization parameters being dependent upon a selected encoding mode for encoding the segments; and an encoding unit arranged for encoding at least the active segments using the selected encoding mode.

* * * * *